US006084561A

United States Patent [19]

Kudo et al.

[11] Patent Number: 6,084,561

[45] Date of Patent: Jul. 4, 2000

[54] LIQUID CRYSTAL CONTROLLER AND LIQUID CRYSTAL DISPLAY UNIT

[75] Inventors: Yasuyuki Kudo, Yokohama; Hiroyuki Mano, Sagamihara; Tsutomu Furuhashi, Yokohama; Shinji Uchida, Chiba; Tomohide Ohira, Mobara; Tatsuhiro Inuzuka, Odawara, all of Japan

[73] Assignees: Hitachi, Ltd., Tokyo; Hitachi Video & Information, Kanagawa-ken, both of Japan

[21] Appl. No.: 08/970,197

[22] Filed: Nov. 14, 1997

[30] Foreign Application Priority Data

Nov. 15, 1996 [JP] Japan ..... 8-304420

[51] Int. Cl.[7] ..... G09G 3/36

[52] U.S. Cl. ..... 345/89; 345/147; 345/153

[58] Field of Search ..... 345/147, 132, 345/155, 87, 88, 89, 211, 153, 520, 521, 507, 501; 348/715, 716, 671, 711

[56] References Cited

U.S. PATENT DOCUMENTS

| | | | |
|---|---|---|---|
| 5,534,883 | 7/1996 | Koh | 345/3 |
| 5,583,530 | 12/1996 | Mano et al. | 345/89 |
| 5,818,409 | 10/1998 | Furuhashi et al. | 345/94 |

FOREIGN PATENT DOCUMENTS 195 38 656 A1 10/1995 Germany .

2 285 163 6/1995 United Kingdom .

OTHER PUBLICATIONS

"Pulse–Height Modulation (PHM) Gray Shading Methods for Passive Matrix LCDS", Conner et al, Proceedings of the International Display Research Conference Japan Display, Jan. 1, 1992, pp. 69–72.

"A 31–In. Diagonal Full–Color Surface–Discharge AC Plasma Display Panel",, Kanagu et al, SID International Symposium Digest of Papers, Boston, May 17–22, 1992, Society for Information Display, pp. 713–716.

*Primary Examiner*—Lun-Yi Lao
*Assistant Examiner*—Jimmy Hai Nguyen
*Attorney, Agent, or Firm*—Antonelli, Terry, Stout & Kraus, LLP

[57] ABSTRACT

A liquid crystal controller for controlling display of a liquid crystal display device of passive matrix type includes gray scale processing being performed on input data before being written in a frame memory for frame frequency conversion and gray scale processing being performed after the frequency conversion and reading of the data from the frame memory so that an amount of information of display data written in the frame memory can be reduced. Further, since the gray scale display pattern is switched by the same switching frequency as the converted frame frequency, pattern movement and flicker of the gray scale display portions can be reduced.

12 Claims, 11 Drawing Sheets

LIQUID CRYSTAL CONTROLLER AND LIQUID CRYSTAL DISPLAY UNIT

BACKGROUND OF THE INVENTION

The present invention relates to a liquid crystal display unit and more particularly to a liquid crystal display unit of a passive matrix type including pixels each formed at each intersecting point of scanning electrodes and data electrodes disposed orthogonally to each other and having the transmission factor which is varied in accordance with an average of squared difference between voltages applied to the scanning electrodes and the data electrodes. Further, the present invention relates to a liquid crystal controller capable of driving the liquid crystal display unit of the passive matrix type at a low cost and with high display quality.

Heretofore, a driving frame frequency for obtaining the optimum contrast in an STN liquid crystal is different depending on a response speed of liquid crystal material. It is known that the frequency is 90 to 120 Hz for the response time of 300 ms and 160 to 240 Hz for 100 ms. The frequency is higher as compared with a frame frequency of 60 to 70 Hz used in a CRT or a TFT liquid crystal. For example, in order to convert a signal having the frame frequency into a display signal for the STN liquid crystal, it is necessary that a frame memory for storing display data is used to convert the frame frequency.

On the other hand, in the STN liquid crystal, a driving method of assigning binary information of display on or off to one pixel is used mainly. Accordingly, in order to display gray scale data, that is, data other than the display on or off in one pixel, any special processing is required. As measures for realizing this processing, there is a frame rate control (FRC) system. In the FRC system, several frames are defined as one period and a rate of the display on or off in the period is set to attain the gray scale. Generally, in the FRC system, as shown in FIG. 2, a pattern (hereinafter referred to as FRC pattern) composed of the display on and off in a matrix having a certain size is formed and the FRC pattern is switched for each frame.

As measures for realizing the conversion of the frame frequency and the gray scale processing, there is a liquid crystal controller. The liquid crystal controller performs the frame frequency conversion and the gray scale processing in accordance with a method as shown in FIG. 3 in which the gray scale processing is first performed and then display data are stored in the frame memory to convert the frame frequency or another method as shown in FIG. 4 in which gray scale data are all stored in the frame memory to convert the frame frequency and then the gray scale processing is performed. Such a controller as shown in FIG. 3 is disclosed in, for example, SID '96 Digest, pp. 356 issued by the Society for Information Display and such a controller as shown in FIG. 4 is disclosed in, for example, a data sheet, pp. 98 of a liquid crystal controller 7548 issued by Cirrus Logic Corporation.

In the conventional liquid crystal controller of, for example, the gray scale processing precedent type, the inputted frame frequency of 60 to 75 Hz is used as the switching frequency of the FRC pattern as it is. Accordingly, there is a problem that the switching of the FRC pattern is apt to be seen and recognized. More particularly, it seems that gray scale display portions are moved or flicker. On the other hand, in the frame frequency conversion precedent type liquid crystal controller, since the gray scale processing is performed after the conversion of the frame frequency, the switching frequency of the FRC pattern is the same as the frame frequency of an output of the liquid crystal and is high to some degree. Accordingly, the pattern movement of the gray scale display portions are reduced. However, since it is necessary to store all of the display data including the gray scale information of several bits per pixel into a frame memory, there is a problem that the frame memory capacity increases.

SUMMARY OF THE INVENTION

It is an object of the present invention to provide a liquid crystal controller which reduces pattern movement in gray scale display portions and prevents increase of the frame memory capacity to thereby solve the above problems.

In order to achieve the above object, gray scale processing for reducing the number of bits of gray scale data is performed at the preceding stage of a frame memory for converting a frame frequency, so that a switching frequency of an FRC pattern is made identical with the frame frequency of a liquid crystal output. As an aspect of this configuration, a liquid crystal control method of the present invention includes a preceding stage for gray scale processing performed before written in the frame memory and a latter stage for gray scale processing performed after conversion of the frequency and reading. With such method configuration, since the number of bits of gray scale data can be reduced by the preceding-stage gray scale processing, increase of the capacity of the frame memory can be prevented. Further, the apparent switching frequency of the FRC pattern is made identical with that of the output by means of the latter-stage gray scale processing, so that pattern movement of the gray scale display portions can be reduced.

Further, a liquid crystal controller of the present invention includes gray scale processors for performing the FRC system and disposed before and after the frame memory. Several bits of n-bit gray scale data inputted to the gray scale processors are subjected to the gray scale processing before written in the frame memory and remaining several bits are subjected to the gray scale processing after read from the frame memory. Display signals obtained by both the gray scale processors are combined to be converted into an output display data of one bit.

The present invention includes not only the liquid crystal controller but also a liquid crystal monitor as shown in FIG. 12.

DESCRIPTION OF THE PREFERRED EMBODIMENTS

Figure 1:
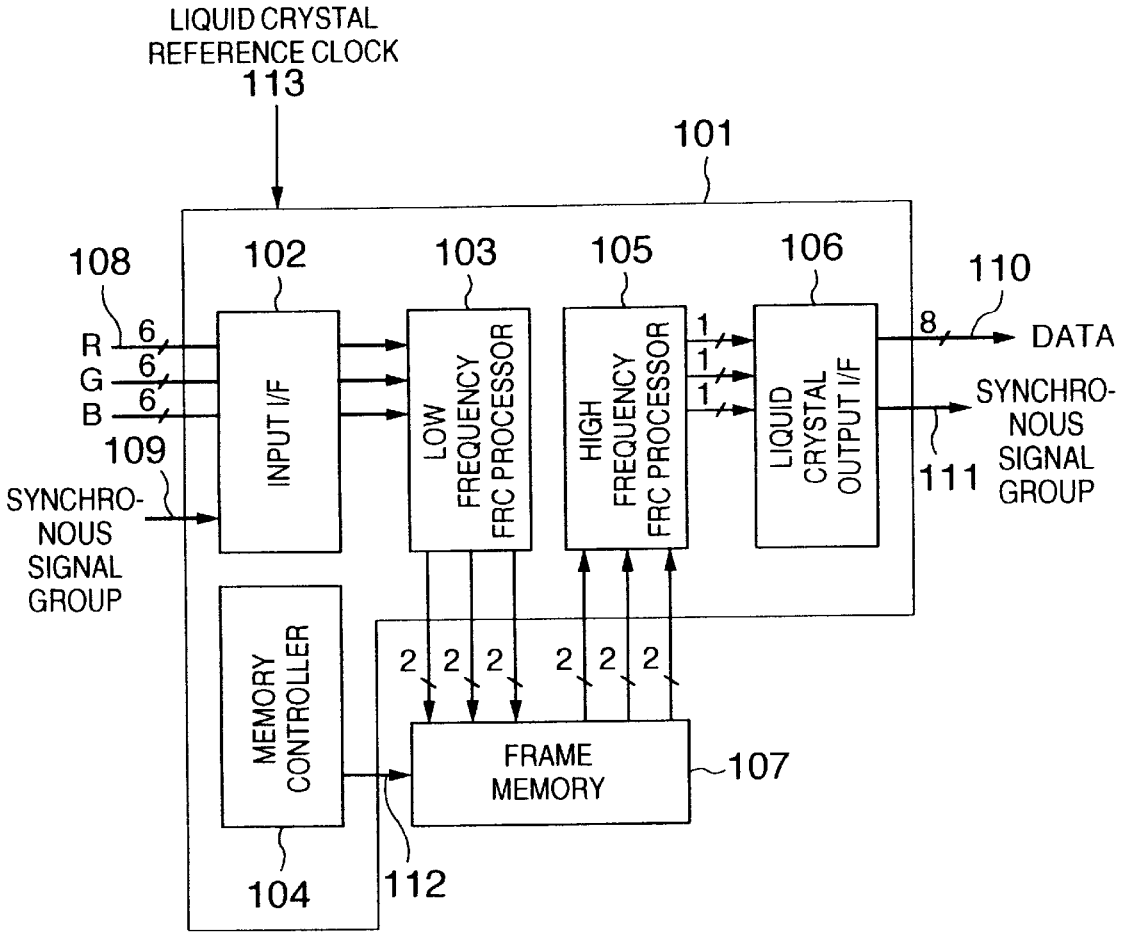
FIG. 1 is a block diagram schematically illustrating a liquid crystal controller according to a first embodiment of the present invention.

FIG. 1 is a block diagram schematically illustrating a liquid crystal controller according to a first embodiment of the present invention. In FIG. 1, numeral 101 denotes a liquid crystal controller of the present invention. In the liquid crystal controller 101, numeral 102 denotes an input interface unit, 103 a gray scale processor provided before a frame memory and which is referred to as a low frequency FRC processor, 104 a memory controller, 105 a gray scale processor provided after the frame memory and which is hereinafter referred to as a high frequency FRC processor, 106 a liquid crystal interface unit, 107 a general-purpose frame memory, 108 an input display data group, and 109 a synchronizing signal group for the input display data. The input display data group 108 and the synchronizing signal group 109 are input signals to the liquid crystal controller. Numeral 110 denotes an output display data group and 111 a synchronizing signal group for the input display data. The output display data group 110 and the synchronizing signal group 111 are output signals of the liquid crystal controller 101. Numeral 112 denotes a memory control signal group which controls writing and reading of display data to the frame memory, and 113 a liquid crystal reference clock, which is an original signal for the synchronizing signal group 111 of the output display data and the data reading signal from the main frame 107.

Operation of each block is now described.

In the input interface unit 102, the display data 108 to be inputted and the synchronizing signal 109 are subjected to adjustment or conversion of the timing thereof used when the data and the signal are supplied to each block. In the embodiment, the display data 108 are separated into R (red), G (green) and B (blue) data, each composed of gray scale data of 6 bits. Further, the input synchronizing signal group 109 includes a clock signal synchronized with the input display data, a signal indicative of switching of a horizontal period, a signal indicative of switching of a frame period, and a signal indicative of an effective time of the display data. These signals conform to, for example, CL2, CL1, FLM and DPTMG signals described in Hitachi LCD controller/driver LSI data book, pp. 1186–1193, "HD66330T (TFT Driver)" issued by Hitachi, Ltd. and the input display data and the mutual timing relation thereof conform to contents described in the same data book.

Figure 5:
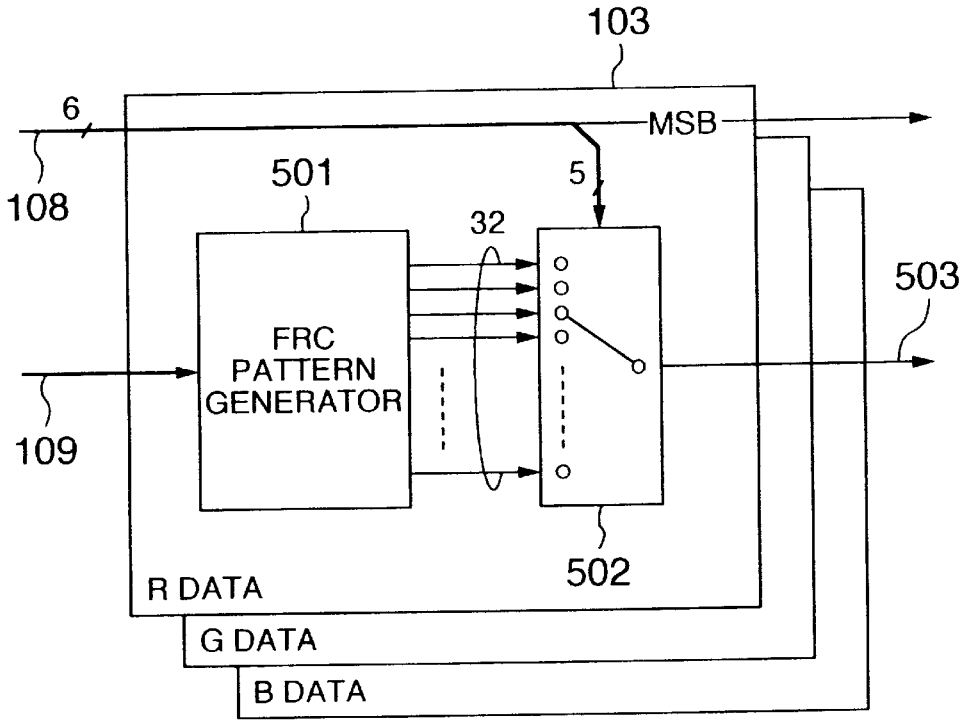
FIG. 5 is a block diagram schematically illustrating a low frequency FRC processor in the liquid crystal controller according to the first embodiment of the present invention.
Figure 6:
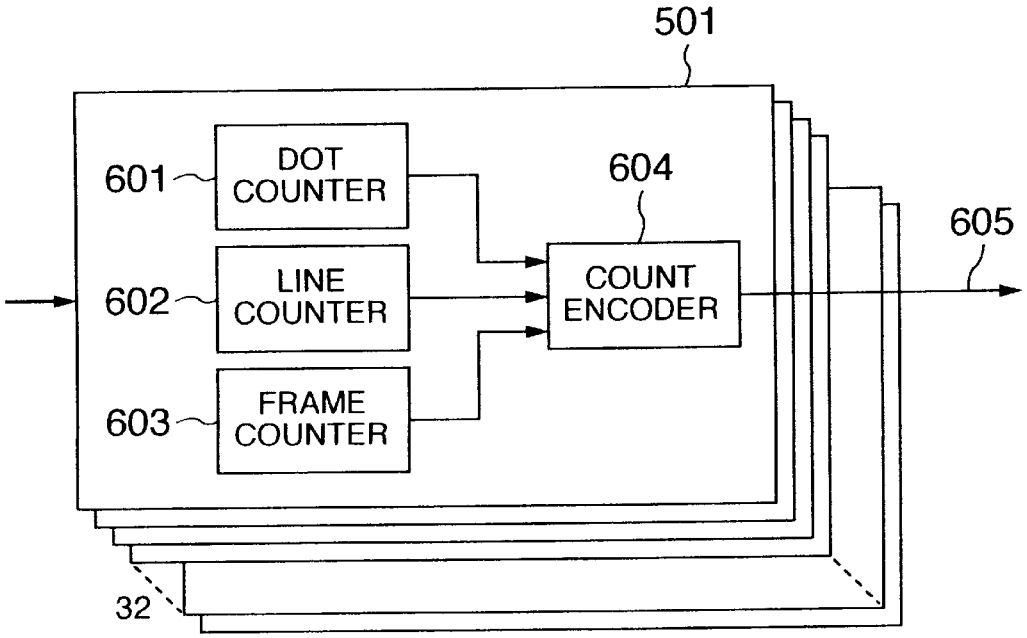
FIG. 6 is a block diagram schematically illustrating a low frequency FRC pattern generator in the liquid crystal controller according to the first embodiment of the present invention.

In the low frequency FRC processor 103, lower 5 bits of each of the 6-bit input display data 108 are subjected to FRC processing to be converted into one-bit display data. The most significant bit thereof is not processed. That is, the 6-bit input display data 108 is produced to the frame memory 107 as 2-bit display data. The low frequency FRC processor 103 includes, as shown in FIG. 5, an FRC pattern generator 501 and an FRC pattern selector 502. The FRC pattern generator 501 generates FRC patterns of 32 kinds corresponding to lower 5 bits of the input data. The FRC pattern selector 502 selects the FRC pattern of 32 kinds generated by the FRC pattern generator 501, in accordance with lower 5 bits of the input display data 108 and produces the selected FRC pattern as a low frequency selection FRC signal 503. The FRC pattern generator 501 includes, as shown in FIG. 6, a dot counter 601, a line counter 602, a frame counter 603 and a count encoder 604. Clocks of the counters 601 to 603 are CL2, CL1 and FLM, respectively, or close resemblances thereto, and periods of the counters 601 to 603 correspond to periods in the horizontal direction, the vertical direction and the frame direction of the FRC pattern, respectively. The count encoder 604 generates a signal corresponding to the display on or off in accordance with counts of the counters 601 to 603 and produces an FRC pattern signal group 605. The combination order of the display on and off in the FRC pattern deeply concerns the display quality of the STN liquid crystal. Accordingly, the way of thinking and an example of a definite FRC pattern for ameliorating the display quality will be described later.

The memory controller 104 produces the memory control signal group 112 from the synchronizing signal group 109 and the liquid crystal reference clock 113. The memory control signal group 112 conforms to the specification of the used frame memory and when HM5241605 described in pp. 858–887 of the IC memory data book issued by Hitachi, Ltd., for example, is used as the frame memory, the frame memory produces the memory control signal group 112 conforming to the memory control signal group described in the data book. A writing control signal group to the frame memory 107 is produced in synchronism with the CL2 of the input synchronizing signal group 109 and a reading control signal group from the frame memory 107 is produced in synchronism with the liquid crystal reference clock 113.

Figure 7:
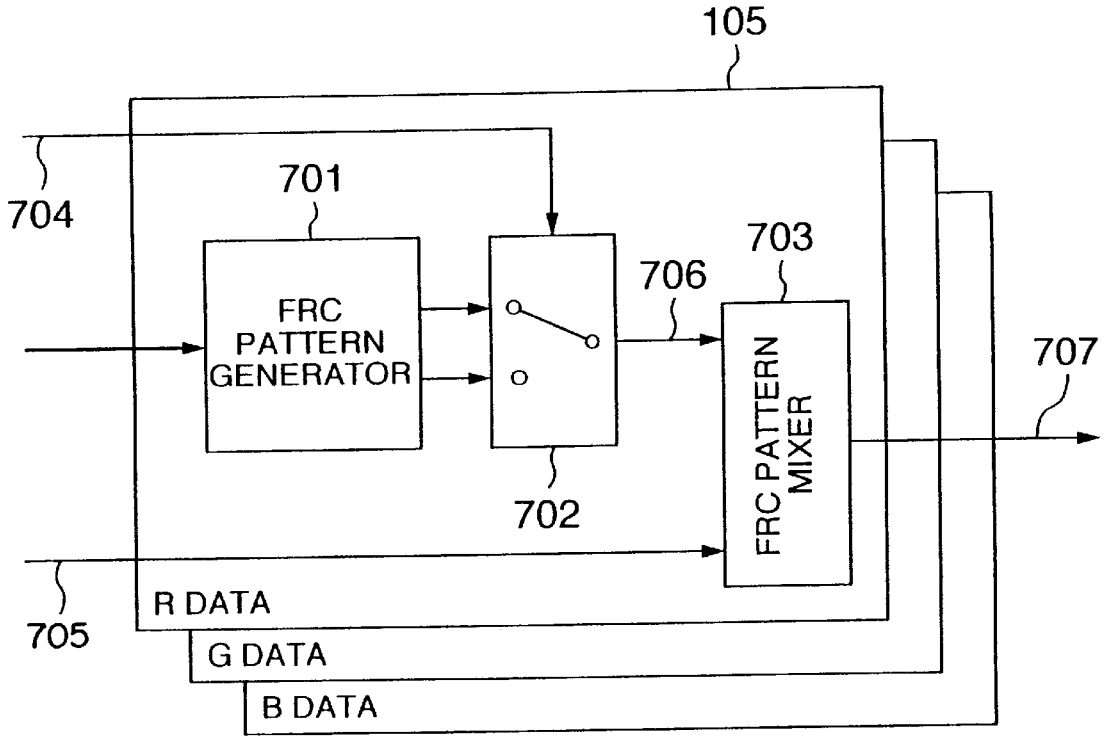
FIG. 7 is a block diagram schematically illustrating a high frequency FRC processor in the liquid crystal controller according to the first embodiment of the present invention.
Figure 8:
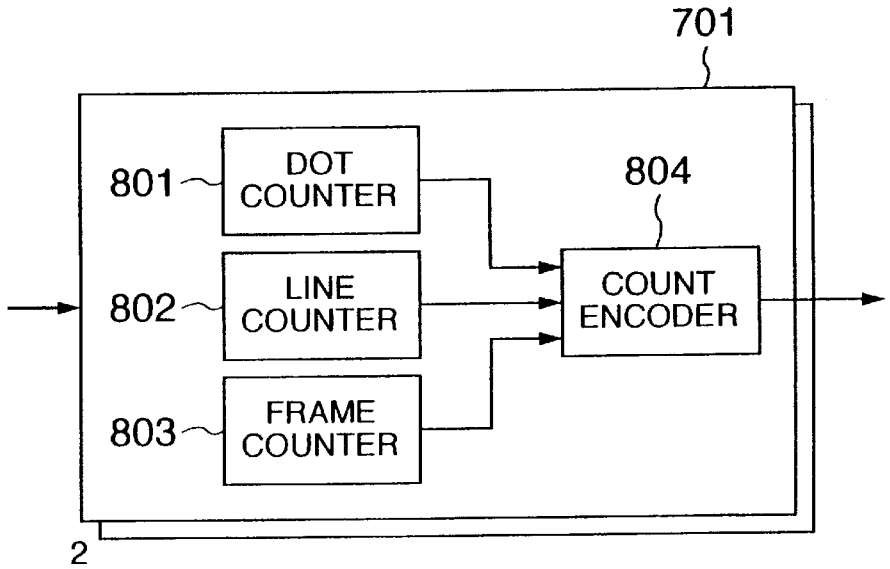
FIG. 8 is a block diagram schematically illustrating a high frequency FRC pattern generator in the liquid crystal controller according to the first embodiment of the present invention.
Figure 9:
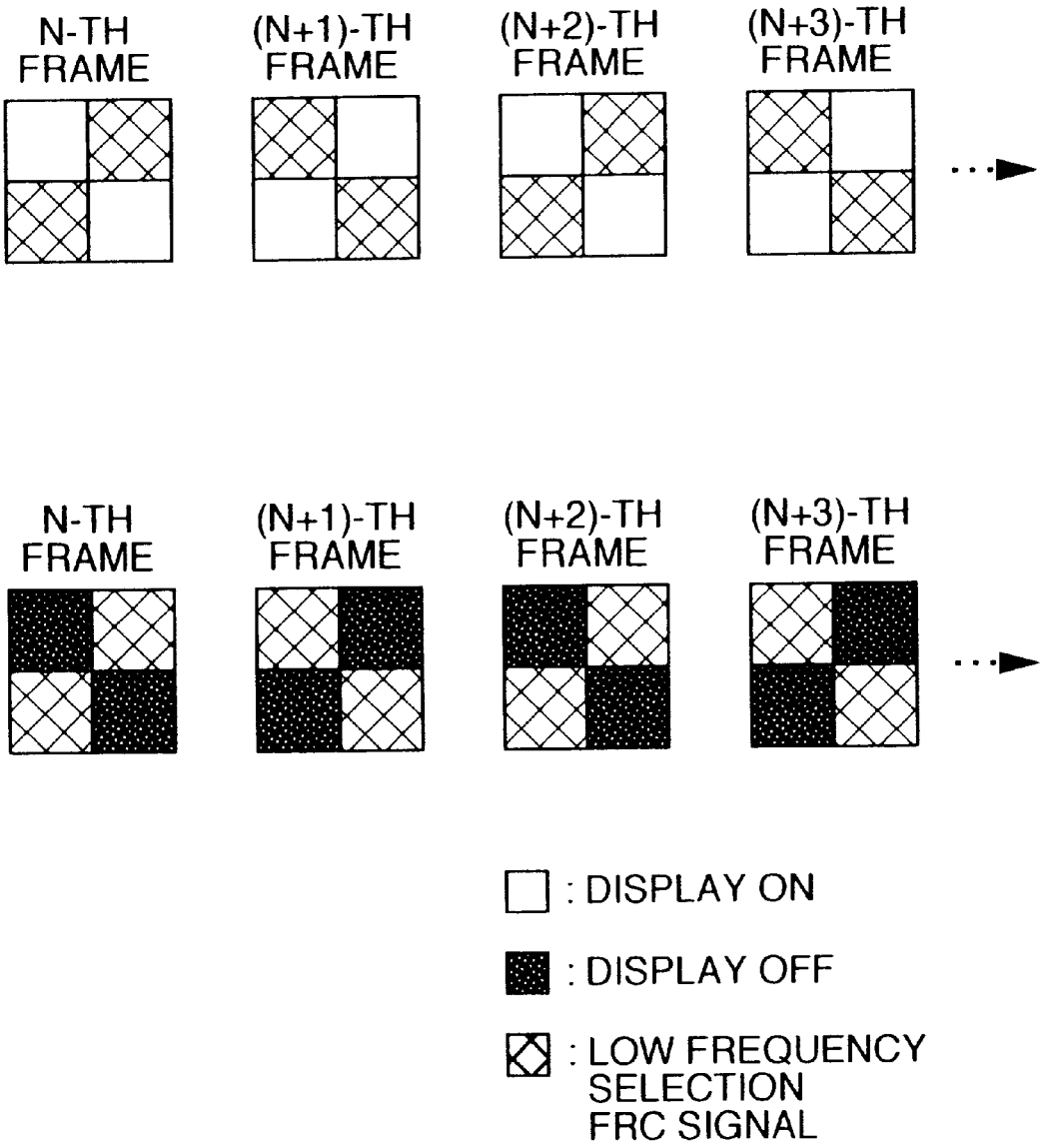
FIG. 9 shows an example of high frequency FRC patterns in the liquid crystal controller according to the first embodiment of the present invention.

The high frequency FRC processor 105 includes, as shown in FIG. 7, an FRC pattern generator 701, an FRC pattern selector 702 and an FRC pattern mixer 703. The FRC pattern generator 701 generates FRC patterns of two kinds corresponding to display data 704 of the most significant bit read from the frame memory 107. The FRC pattern selector 702 selects the FRC pattern of two kinds generated by the FRC pattern generator 701 in accordance with a value of the most significant bit of the display data 704 and produces it as a high frequency selection FRC signal 706. The FRC pattern mixer 703 takes a logical AND of the high frequency selection FRC signal 706 and the low frequency selection FRC signal 705 read from the frame memory 107 and produces it as a gray scale processing signal 707. The FRC pattern generator 701 includes, as shown in FIG. 8, a dot counter 801, a line counter 802, a frame counter 803 and a counter encoder 804. Clocks of the counters 801 to 803 are liquid crystal output synchronizing signals CL2, CL1 and FLM described later, respectively, or close resemblances thereto. The respective periods of the clocks of the counters 801 to 802 are all 2 and correspond to the periods in the horizontal direction, the vertical direction and the frame direction of the FRC pattern. The counter encoder 804 produces a signal corresponding to the display on and off in accordance with counts of the counters 801 to 803 and generates an FRC pattern. FIG. 9 shows an example of the FRC patterns of two kinds generated by the high frequency FRC processor 105. As apparent from FIG. 9, the FRC pattern is a checker-board pattern of two by two pixels constituting a unit matrix and includes one half portion in which display on or off data is displayed and the other half portion in which the low frequency selection FRC signal 705 is displayed as it is. Further, locations of these portions are switched one after the other for each frame.

The liquid crystal interface unit 106 converts the gray scale processing signals 707 for R, G and B data of each one bit converted by the high frequency FRC processing unit 105 to produce the output display data group 110. Further, the liquid crystal interface unit 106 produces the output synchronizing signal group 111 from the liquid crystal reference clock 113. In the embodiment, the output display data group 110 are assumed to be produced in the form of 8 pixels in parallel. In addition, the output synchronizing signal group 111 conforms to CL2, CL1, FLM and DISPOFF described in Hitachi LCD controller/driver LSI data book, pp. 737–750 issued by Hitachi, Ltd., for example, and the output display data 110 and the mutual timing relation conform to description of the data book.

Figure 10:
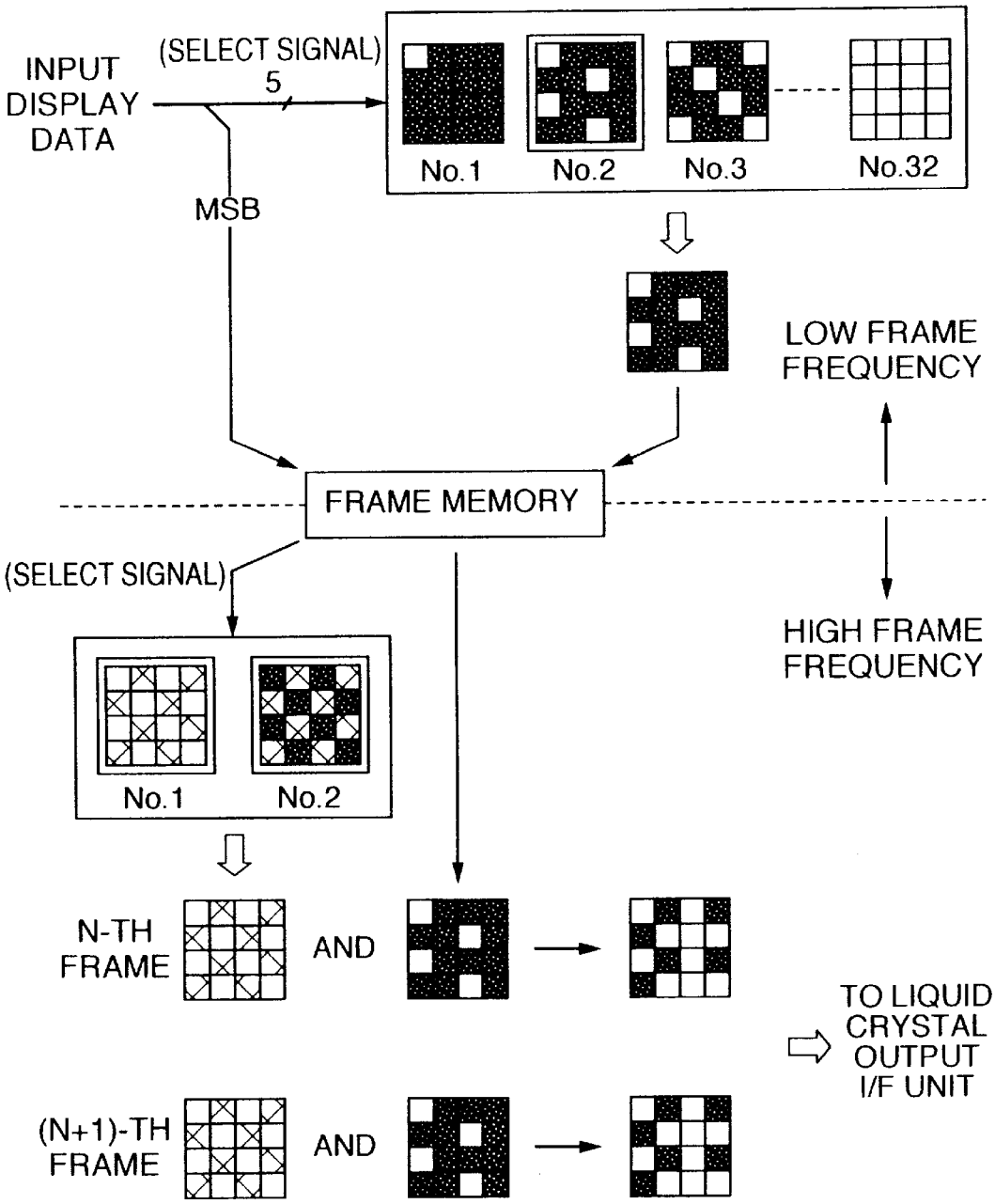
FIG. 10 shows a flow of processing of display data in the liquid crystal controller according to the first embodiment of the present invention.

The flow of the gray scale processing of the display data in the first embodiment of the present invention as described above is shown in FIG. 10 collectively. As will be understood from FIG. 10, when the gray scale data of 6 bits to be inputted is written in the frame memory, the gray scale data is reduced to two bits and accordingly the capacity of the frame memory can be reduced. Further, the switching frequency of the FRC pattern is the same as the frame frequency of the produced liquid crystal output signal and accordingly pattern movement in the gray scale display portion can be reduced. In addition, it is desirable that the output frame frequency is an integral multiple of the input frame frequency. This reason is that the completion period of the mixed FRC pattern in the frame direction is short and pattern movement in the gray scale display portion can be more reduced. It is desirable that the timing adjustment is made in the retrace period in which any scanning electrodes do not perform selective scanning. Further, in the embodiment, for simplicity of description, the output data of the liquid crystal is supposed to have 8 parallel pixels, while the present invention is not limited thereto and for example the picture data may be divided into upper picture data and lower picture data to be outputted. In this case, when two planes for upper picture and lower picture are provided as the frame memory, control thereof is easy. Further, in the embodiment, the most significant bit of the input data is set to be the selection signal of the high frequency FRC pattern, while the selection signal is not limited thereto and the upper 2 bits of the input data may be used as the selection signal of the high frequency FRC pattern. In this case, the display data written in the frame memory includes three bits per pixel, while the frame memory is required to have the capacity sufficient to store the display data of three bits per pixel.

Figure 2:
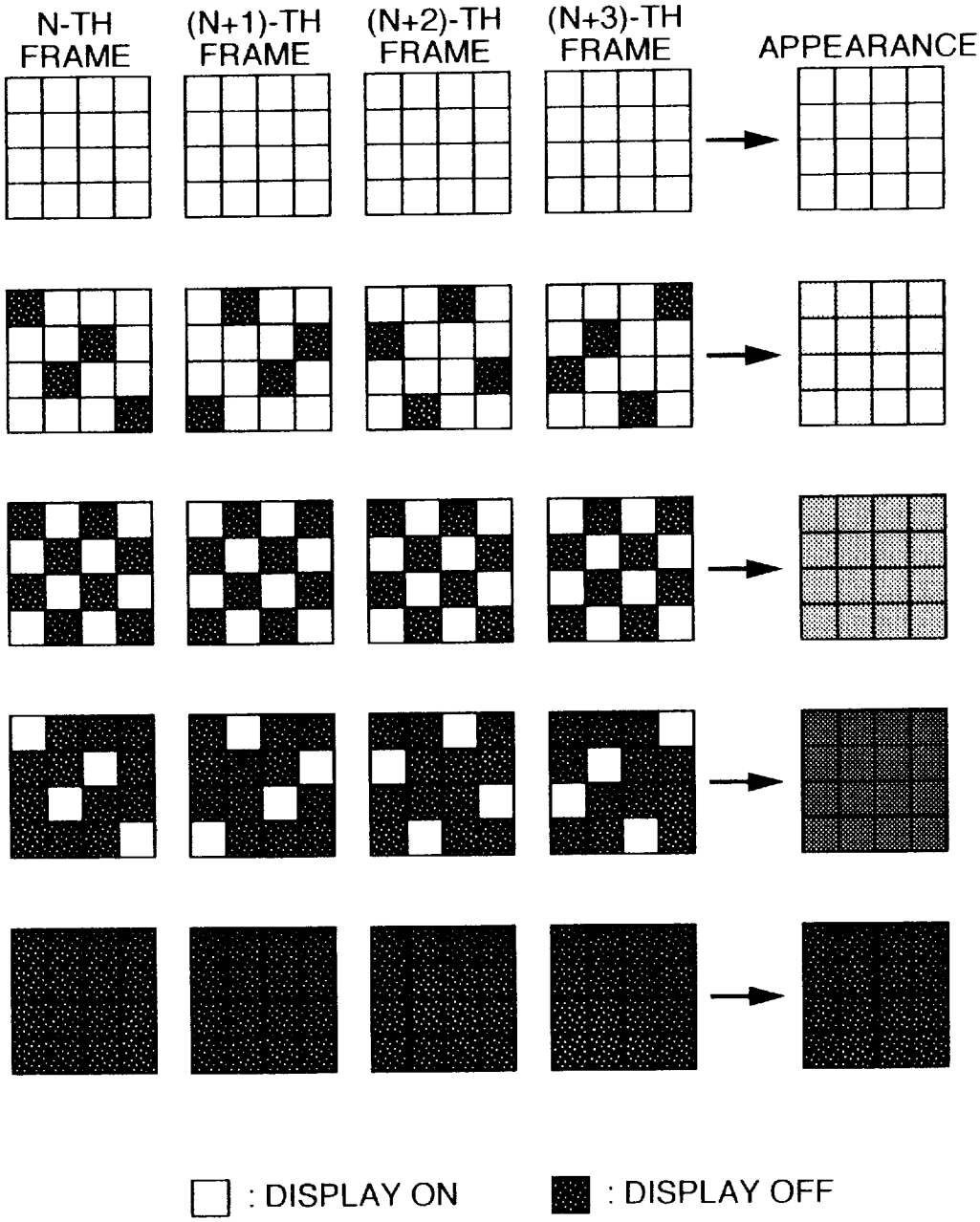
FIG. 2 is a diagram illustrating a processing method of the gray scale display.
Figure 3:
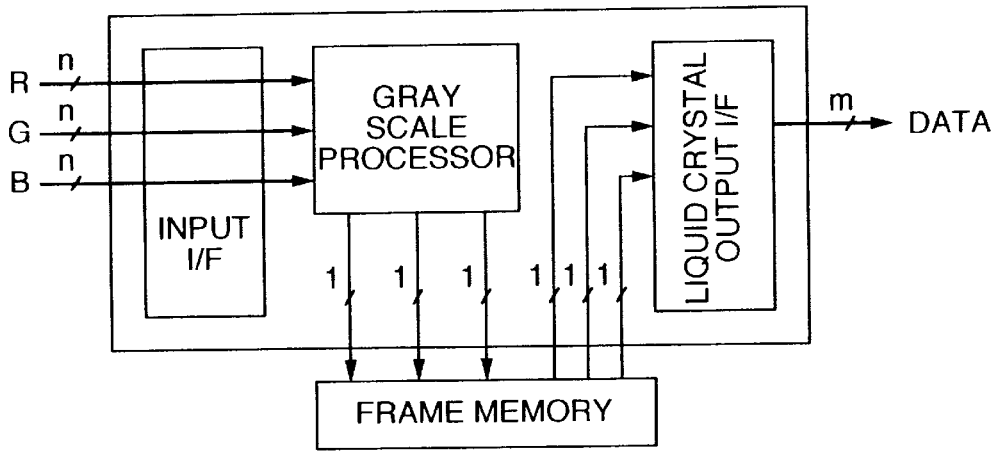
FIG.3 PRIOR ART
FIG. 3 is a block diagram schematically illustrating a conventional liquid crystal controller.
Figure 4:
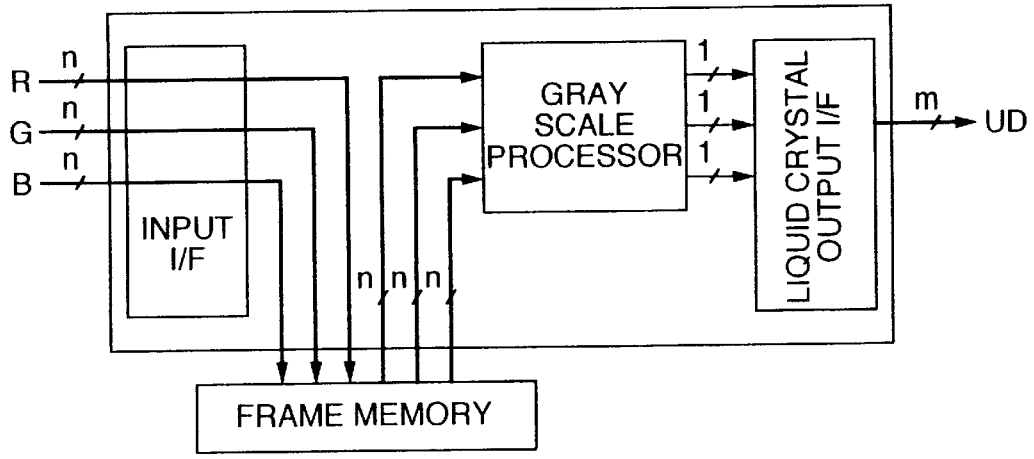
FIG.4 PRIOR ART
FIG. 4 is a block diagram schematically illustrating another prior art liquid crystal controller.

Further, when the embodiment is used, display can be changed for each frame even if the frame memory is not provided for the capacity of the display data. The change for each frame means that the display for the N-th frame is different from the display for the (N+1)-th frame in the display example shown in FIG. 2. In the prior art, the frame memory must be provided for the capacity of the display data. Further, when the capacity of the display data cannot be provided, the same display is repeated twice or more. The display data is the gray scale data separated into R (red), G (green) and B (blue) data each 6 bits.

A second embodiment of the present invention is now described.

Figure 11:
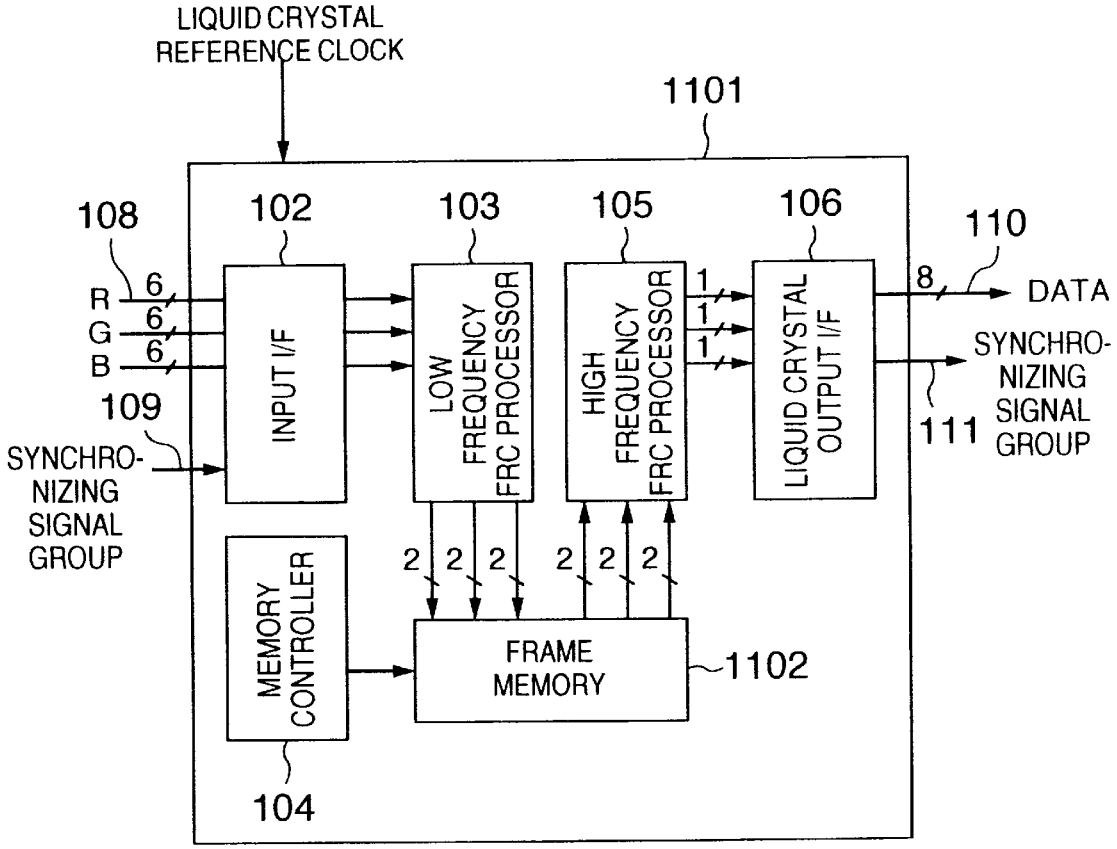
FIG. 11 is a block diagram schematically illustrating a liquid crystal controller according to a second embodiment of the present invention.

In the second embodiment of the present invention, the frame memory in the first embodiment of the present invention is provided in the liquid crystal controller. FIG. 11 is a schematic diagram illustrating the second embodiment. Numeral 1101 denotes a liquid crystal controller of the present invention and 1102 a frame memory. Other blocks and signal groups are the same as those of the liquid crystal controller of the first embodiment and perform the same operation. Accordingly, detailed description of operation of the embodiment is omitted. Since the second embodiment of the present invention can be realized by one-chip LSI including the frame memory, the high-speed circuit operation and the low-cost system configuration can be attained.

The second embodiment can attain the same effects as in the first embodiment.

A third embodiment of the present invention is now described.

Figure 12:
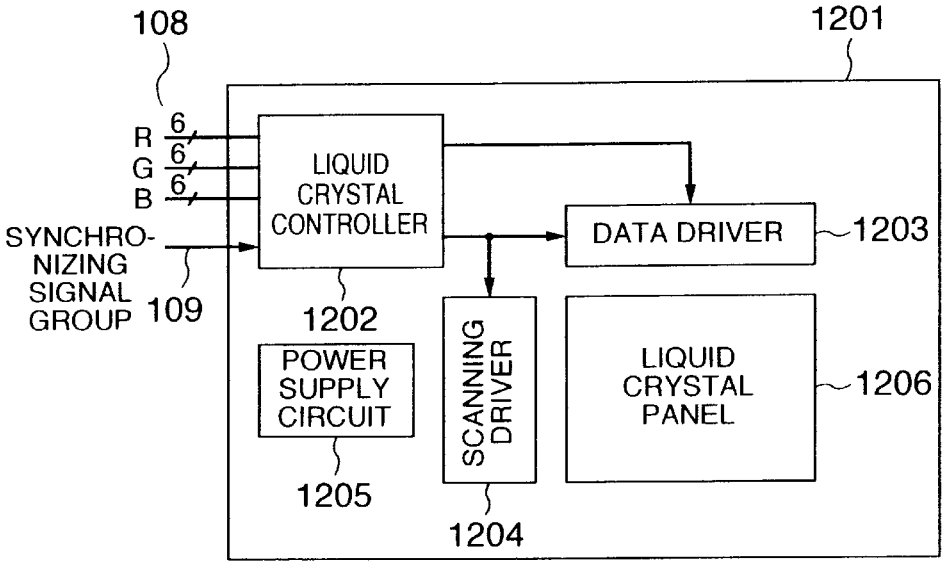
FIG. 12 is a block diagram schematically illustrating a liquid crystal controller according to a third embodiment of the present invention.

In the third embodiment of the present invention, the liquid crystal controller in the first and second embodiments of the present invention is included in a liquid crystal module. FIG. 12 is a schematic diagram illustrating the third embodiment. Numeral 1201 denotes a liquid crystal module and 1202 a liquid crystal controller, which is the same as that in the first and second embodiments of the present invention. Numeral 1203 denotes a data driver, which can be realized by means of a liquid crystal driver described in Hitachi LCD controller/driver LSI data book, pp. 737–750 issued by Hitachi, Ltd., for example. Numeral 1204 denotes a scanning driver, which can be realized by means of a liquid crystal driver described in Hitachi LCD controller/driver LSI data book, pp. 751–771 issued by Hitachi, Ltd., for example. Numeral 1205 denotes a power supply circuit, which produces a power supply voltage required in the data driver 1203 and the scanning driver 1204. Numeral 1206 denotes a liquid crystal panel of the passive matrix type. The input signals of the liquid crystal module 1201 of the present invention are the same as the input signals of the liquid crystal controller of the first and second embodiments of the present invention and inputted to the liquid crystal controller 1202. Further, the output signals of the liquid crystal control 1202 are the same as the output signals of the liquid crystal controller of the first and second embodiment of the present invention and supplied to the data driver 1203 and the scanning driver 1204. As described above, in the third embodiment of the present invention, since the liquid crystal controller is included in the liquid crystal module, the digital data for R, G and B data each being 6 bits, for example, can be made to the input signals. Since the digital data for R, G and B data each being 6 bits are originally the input signals of the TFT liquid crystal module, the liquid crystal module of the third embodiment of the present invention can include the interchangeability of the interface to the TFT liquid crystal module.

A fourth embodiment of the present invention is now described.

Figure 13:
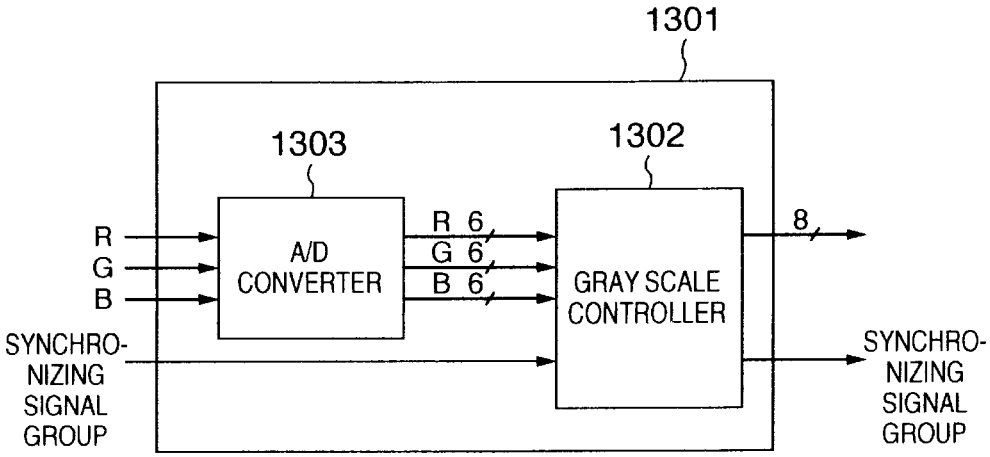
FIG. 13 is a block diagram schematically illustrating a liquid crystal controller according to a fourth embodiment of the present invention.

In the fourth embodiment of the present invention, an A/D converter is provided before the liquid crystal controller in the first and second embodiments of the present invention. FIG. 13 is a schematic diagram illustrating the fourth embodiment. Numeral 1301 denotes a liquid crystal controller of the present invention, 1302 a scale processing controller, and 1303 an A/D converter. The scale processing controller 1302 is the same as the liquid crystal controller in the first and second embodiments of the present invention. The A/D converter 1303 can be realized by means of CXA3086Q described in A/D converter data book pp. 1–8 issued by Sony, for example. The input of the A/D converter has the interchangeability with CRT and the output thereof has the interchangeability with the TFT liquid crystal module. That is, by using the liquid crystal display controller of the fourth embodiment of the present invention, the STN liquid crystal display unit having the interchangeability of interface to the CRT can be realized.

A fifth embodiment of the present invention is now described.

The fifth embodiment of the present invention describes the way of thinking of the FRC pattern and a definite example for ameliorating the display quality for the liquid crystal controller of the present invention.

Figure 14:
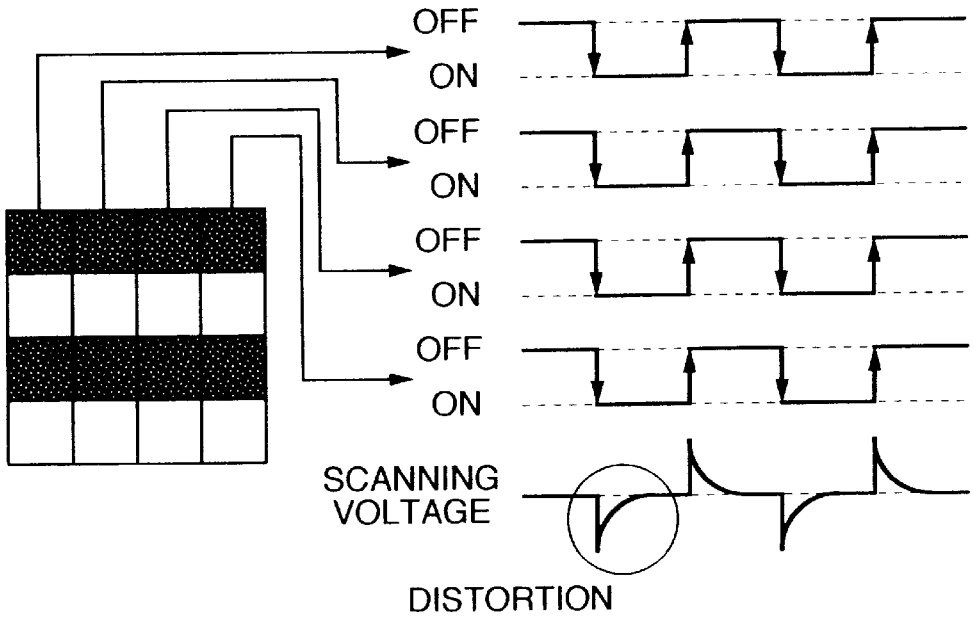
FIG. 14 is a model diagram showing a relation of a display pattern and voltage waveforms applied to the liquid crystal according to the fourth embodiment of the present invention.
Figure 15:
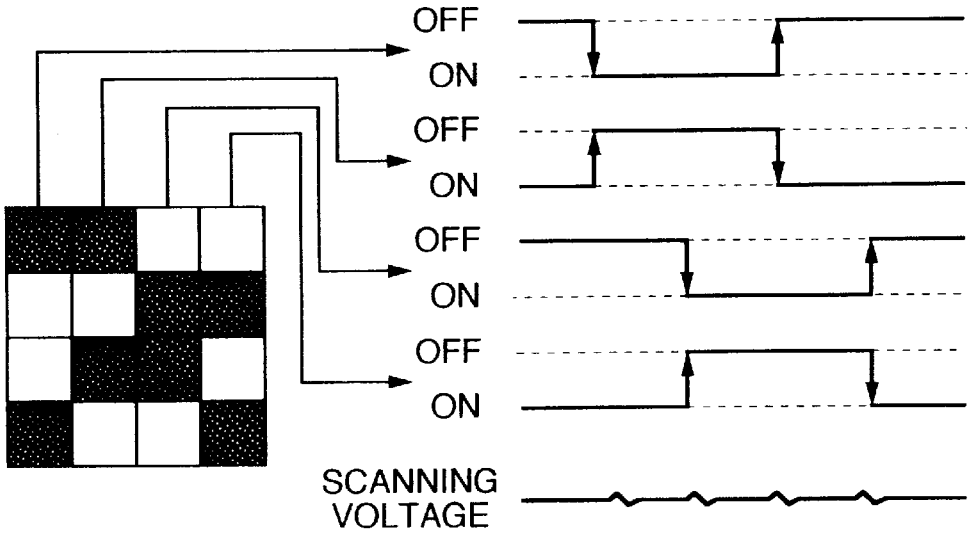
FIG. 15 is a model diagram showing a relation of a display pattern and voltage waveforms applied to the liquid crystal according to the fourth embodiment of the present invention.
Figure 16:
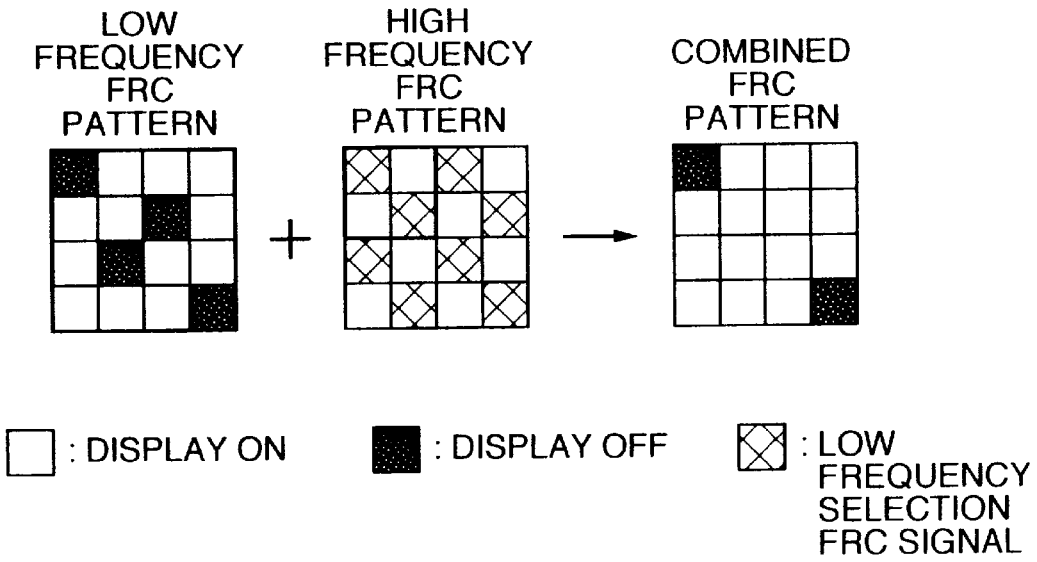
FIG. 16 shows an example of FRC patterns according to the fourth embodiment of the present invention.
Figure 17:
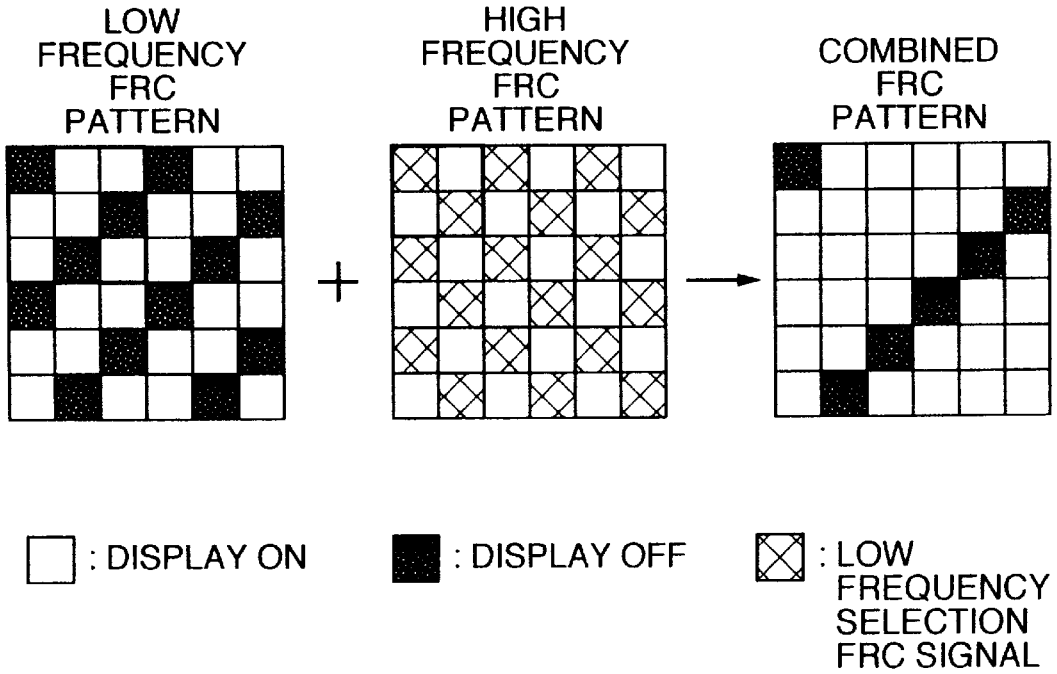
FIG. 17 shows an example of FRC patterns according to the fourth embodiment of the present invention.

FIGS. 14 and 15 show FRC patterns and liquid crystal applied voltage waveforms when the FRC patterns are displayed. In the pattern shown in FIG. 14, since all of data voltages are simultaneously changed in the same direction, the changes cause distortion of the scanning voltage waveform by means of a capacitance component of the liquid crystal and a resistance component of the electrodes. Since the distortion of the scanning voltage waveform changes an effective value of the liquid crystal applied voltage, cross-talk named shadowing is apt to be produced. In the pattern shown in FIG. 15, the changing directions of the data voltages are opposite on halves. In this case, distortion of the scanning voltage waveform is canceled each other and is hardly produced. Accordingly, in this case, the shadowing can be reduced. There is considered the condition that the changing directions of the data voltages are opposite on halves as the pattern shown in FIG. 15. The condition is that a rate of display on and off in the FRC pattern matrix is constant on any scanning line (in FIG. 15, the rate of the display on and off is 2, that is, display on:display off=2:2). In the liquid crystal controller of the present invention, the low frequency FRC pattern and the high frequency FRC pattern are combined to be displayed. Accordingly, it is required that the combined FRC pattern satisfies the above condition. This condition is described with reference to FIGS. 16 and 17. In FIG. 16 the low frequency FRC pattern is constituted by a matrix of 4×4 pixels and in FIG. 17 the low frequency FRC pattern is constituted by a matrix of 3×3 pixels. The high frequency pattern is the checker-board pattern of 2×2 pixels in the same manner as the first to fourth embodiments of the present invention. The low frequency FRC pattern in FIGS. 16 and 17 satisfies the above-described condition that the rate of the display on and off in the FRC pattern matrix is constant on any scanning line. In the FRC pattern of FIG. 16, since the size (period) of the matrix of the combined FRC pattern is the least common multiple of the sizes of the matrixes of the low frequency FRC pattern and the high frequency FRC pattern, the matrix of the combined FRC pattern is composed of 4×4 pixels. At this time, the rate of the display on and off in the FRC pattern matrix is different depending on the scanning line. Accordingly, in the case of FIG. 16, since the distortion occurs in the scanning voltage waveform as described above, the shadowing is apt to be produced. On the contrary, in the FRC pattern of FIG. 17, since the size (period) of the matrix of the combined FRC pattern is the least common multiple of the sizes of the matrixes of the low frequency FRC pattern and the high frequency FRC pattern, the matrix of the combined FRC pattern is composed of 6×6 pixels. At this time, the rate of the display on and off in the FRC pattern matrix is 5 to 1 (5:1) irrespective of the scanning line. Accordingly, in the case of FIG. 17, since distortion of the scanning voltage waveform is hardly produced, the shadowing can be reduced. As shown in FIG. 17, in the combined FRC pattern, there is considered the condition that the rate of the display on and off in the FRC pattern matrix is constant on any scanning line. The condition is that the number of pixels in the direction of the scanning line of the matrix of the low frequency FRC pattern is made odd when the high frequency FRC pattern is the checker-board pattern. In brief, the condition of the FRC pattern for ameliorating the display quality can be expressed from the above consideration by the definition that the rate of the display on and off in the low frequency FRC pattern matrix is constant on any scanning line and the number of pixels in the direction of the scanning line of the matrix of the low frequency FRC pattern is odd.

In the fifth embodiment of the present invention, the high frequency FRC pattern is set to be the checker-board pattern of 2×2 pixels, while the present invention is not limited thereto and as far as the condition that the rate of the display on and off in the combined FRC pattern matrix is constant on any scanning line is satisfied, any pattern may be used.

As described above, in the first to fourth embodiments of the present invention, since the number of bits for the gray scale data can be reduced by the gray scale processing performed before the frame memory, increase of the capacity of the frame memory can be prevented. Further, the apparent switching frequency of the FRC pattern can be made identical with that of the output by the gray scale processing performed after the frame memory, so that pattern movement in the gray scale display portion can be reduced. Further, the combined FRC pattern of the condition described in the fifth embodiment of the present invention can be used to attain the gray scale display with high quality in which occurrence of shadowing is suppressed. It is desirable that the combined FRC pattern of the condition described in the fifth embodiment of the present invention is applied to the liquid crystal controller of the first to fourth embodiments of the present invention.

According to the present invention, in the controller of the liquid crystal display of the passive matrix type in which pixels are formed at the intersecting points of the scanning electrodes and the data electrodes disposed orthogonally to each other and the pixels have the transmission factor which is varied in accordance with an average of squared differences of voltages applied to the scanning electrodes and the data electrodes, increase of the capacity of the frame memory for temporarily storing the display data can be prevented and pattern movement and flicker in the gray scale display portion can be reduced. Further, the display pattern of the gray scale of the present invention can be used to attain the gray scale display with high quality in which occurrent of cross-talk is suppressed.

What is claimed is:

1. A liquid crystal controller for controlling a liquid crystal display device of passive matrix type in which pixels are formed at intersecting points of scanning electrodes and data electrodes disposed orthogonally to each other and the pixels have a transmission factor which is varied in accordance with an average of squared differences of voltages applied to the scanning electrodes and the data electrodes;

said liquid crystal controller including a frame memory which converts a frame frequency in order to drive said liquid crystal display device of passive matrix type with a higher frame frequency than an inputted frame frequency;

said liquid crystal controller performing gray scale processing using a frame rate control or FRC processing in which several frames are set to one period and a rate of display on and off is set in said period in order to convert input gray scale data of n bits into one bit;

said liquid crystal controller comprising gray scale processors including a first frequency gray scale processor disposed before said frame memory and which converts several bits of said input n-bit gray scale data to one bit in accordance with first FRC patterns and a second frequency gray scale processor disposed after said frame memory which converts remaining several bits of said input n-bit gray scale data to one bit in accordance with second FRC patterns;

wherein said liquid crystal controller obtains display signals by both of said first and second gray scale processors being combined to be converted into said output display data of one bit.

2. A liquid crystal controller according to claim 1, wherein said first frequency gray scale processor and said second frequency gray scale processor use a control method in which matrixes each having several pixels in horizontal and vertical directions are formed and FRC patterns having display on and off in each of the matrixes are generated and switched for each frame;

each of said FRC patterns used in said second frequency gray scale processor being a checker-board pattern having a unit matrix of 2 pixels by 2 pixels and having one half portion in which display on or off data is displayed and the other half portion in which signals produced by said first frequency gray scale processor are displayed as they are, said portions being switched one after the other in each frame;

the display signal processed by said second frequency gray scale processor comprising a most significant bit of said n-bit gray scale data.

3. A liquid crystal controller according to claim 1, wherein said frame memory is included in said liquid crystal controller and is formed by one-chip LSI.

4. A liquid crystal controller according to claim 1, further comprising an A/D converter provided at an input of said liquid crystal controller.

5. A liquid crystal display apparatus including a liquid crystal display device of passive matrix type in which pixels are formed at intersecting points of scanning electrodes and data electrodes disposed orthogonally to each other and the pixels have a transmission factor which is varied in accordance with an average of squared differences of voltages applied to the scanning electrodes and the data electrodes, data drivers for applying to said data electrodes a voltage in accordance with display information, scanning drivers for producing an unselected scanning voltage and a selected scanning voltage to said scanning electrodes, a power supply circuit for producing a power supply voltage required to drive said data drivers and said scanning drivers, and a liquid crystal controller for supplying a control signal required to operate said data drivers and said scanning drivers and display data;

said liquid crystal controller including a frame memory for converting a frame frequency in order to drive said liquid crystal display device of passive matrix type with a higher frame frequency than an input frame frequency and said liquid crystal controller producing a signal group required to control said frame memory;

said liquid crystal controller performing gray scale processing using a frame rate control or FRC processing in which several frames are set as one period and a rate of display on and off is set in said period in order to convert input gray scale data of n bits into one bit;

said liquid crystal controller including a first frequency gray scale processor disposed before said frame memory for converting several bits of said input n-bit gray scale data to one bit in accordance with first FRC patterns of said FRC processing and a second frequency gray scale processor disposed after said frame memory for converting remaining several bits of said input n-bit gray scale data to one bit in accordance with second FRC patterns of said FRC processing;

wherein said liquid crystal controller obtains display signals by both of said first and second gray scale processors being combined to be converted into said output display data of one bit.

6. A liquid crystal display apparatus according to claim 5, further comprising an A/D converter provided an input of said liquid crystal controller.

7. A liquid crystal display apparatus according to claim 5, wherein said frame memory is included in said liquid crystal controller and is formed by one-chip LSI.

8. A gray scale processing method in a liquid crystal controller for assigning binary information of display on or off to one pixel of a liquid crystal display, comprising:

a first step of converting several bits of inputted n-bit gray scale data representing a tone level to be displayed by one pixel of said liquid crystal display to one bit in accordance with first FRC patterns;

a second step of storing converted display data with said FRC patterns in a frame memory for performing conversion processing of a frame frequency; and a third step of converting remaining several bits of said inputted n-bit gray scale data on one pixel of said liquid crystal display and data read out from said frame memory to one bit in accordance with second FRC patterns.

9. A liquid crystal controller including a frame memory for performing conversion processing of a frame frequency and coupled to a liquid crystal display, comprising:

a first gray scale processor for performing gray scale processing to a several bits of an input n-bit gray scale data in accordance with first FRC patterns of FRC processing and supplying the data being one bit and remaining several bits of said input n-bit gray scale data on one pixel of said liquid crystal display to said frame memory; and a second gray scale processor for performing the gray scale processing to said remaining several bits of said input n-bit gray scale data which is read out from said frame memory not subjected to the gray scale processing in said first gray scale processor in accordance with second FRC patterns of said FRC processing to obtain one bit, wherein said liquid crystal controller obtains display signals by both of said first and second gray scale processors being combined to be converted into said output display data of one bit, on one pixel of said liquid crystal display.

10. A liquid crystal display apparatus including a liquid crystal display and a liquid crystal controller provided with a frame memory for performing conversion processing of a frame frequency, wherein said liquid crystal controller includes:

a first gray scale processor for performing gray scale processing to several bits of an input n-bit gray scale data in accordance with first FRC patterns and supplying the data being one bit and remaining several bits of said input n-bit gray scale data on one pixel of said liquid crystal display to said frame memory; and a second gray scale processor for performing the gray scale processing to said remaining several bits of said input n-bit gray scale data which is read out from said frame memory not subjected to the gray scale processing in said first gray scale processor in accordance with second FRC patterns of said FRC processing to obtain one bit, wherein said liquid crystal controller obtains display signals by both of said first and second gray scale processors being combined to be converted into said output display data of one bit, on one pixel of said liquid crystal display.

11. A liquid crystal display apparatus according to claim 10, further comprising an A/D converter provided at an input of said liquid crystal controller.

12. A liquid crystal display apparatus according to claim 10, wherein said frame memory is included in said liquid crystal controller and is formed one-chip LSI.

* * * * *